US005253664A

United States Patent [19]

Wilson

[11] Patent Number: 5,253,664

[45] Date of Patent: Oct. 19, 1993

[54] DRAIN BLASTER

[75] Inventor: Timothy J. Wilson, Baltimore, Md.

[73] Assignee: Jet Blast Products Corporation, Baltimore, Md.

[21] Appl. No.: 913,176

[22] Filed: Jul. 14, 1992

[51] Int. Cl.[5] ..... B08B 9/04

[52] U.S. Cl. ..... 134/167 C; 239/DIG. 13; 239/251

[58] Field of Search ..... 134/167 C, 168 C; 239/DIG. 13, 251; 4/255.04, 255.06

[56] References Cited

U.S. PATENT DOCUMENTS 2,500,404 3/1950 Donnelly ..... 4/255.06
3,075,535 1/1963 Lasting ..... 134/167 C
4,909,325 3/1990 Hopmann ..... 134/167 C X

*Primary Examiner*—Philip R. Coe
*Attorney, Agent, or Firm*—Banner, Birch, McKie and Beckett

[57] ABSTRACT

A fluid jet cleaning system, particularly adapted for household use, comprises an elongated flexible hose coupled at one end through a quick-operating on-off valve to a source of pressurized water and whose other end contains a jet nozzle assembly including a head having an ejector opening for discharging a high velocity jet stream for dislodging collected debris and a rotatable spinner sleeve containing tangential openings for emitting additional jet streams that rotate and that flush the debris and provide a secondary cleansing of the drain wall surface.

7 Claims, 2 Drawing Sheets

DRAIN BLASTER

BACKGROUND OF THE INVENTION

The present invention relates to cleaning apparatus for household appliances. More particularly, the invention relates to a simply arranged organization of inexpensive elements forming a system for the utilization of water at typical household pressures to develop high velocity jet streams capable of effectively freeing pipes of debris blockages or for other cleaning purposes.

In the past, debris blockages in household drains have been released by the use of hydraulic pressurization devices, rotating mechanical snaking apparatus or by the application of fluidized toxic chemical compositions, either at atmospheric or at an elevated pressure. None of these solutions have been totally dispositive of the problem. Hydraulic pressurization devices do not clean pipes adequately and may even damage them. The use of snaking equipment requires a significant amount of physical effort to implement and necessitates a high degree of care in order to prevent damage to the pipe being cleaned and to the surrounding work area. The use of chemical flushing compositions, on the other hand, can be hazardous both to the user and to the environment.

Apparatus constructed in accordance with the invention has been found to be conducive not only for freeing drains of various household appliances such as sinks, tubs, toilets and garbage disposals but it has also been found to be particularly effective for cleaning narrow neck bottles and for flushing automobile radiators.

The use of fluid jet applicators for material removal is well known. Such devices characteristically employ the high velocity fluid as a medium for propelling a mechanical tool that performs the actual material removal work. Devices of this type are shown and described in U.S. Pat. Nos. 1,554,512; 2,336,293; 3,167,126 and 4,406,332. Other devices, where the material to be removed is dislodged at least in part by a nozzle-created fluid jet are typically employed for subterranean boring, material moving, or the like, and are characteristically of more complicated construction. Such devices are exemplified in U.S. Pat. Nos. 1,448,876 and 4,909,325. U.S. Pat. No. 4,031,971 discloses a hybrid device in which material is removed by means of a drilling assembly in which a plurality of revolving jet streams are created by a nozzle head which is rotated under the impetus of the jet streams.

Such devices, due to their complex design, are too expensive for household use and therefore are typically limited to industrial applications.

It is the development of a simple, inexpensive fluid jet cleaning system effective for household use, therefore, to which the present invention is directed.

SUMMARY OF THE INVENTION

According to the present invention, there is provided a fluid jet cleaning system, particularly adapted for household use, comprising an elongated flexible hose, coupling means at one end of the hose to effect connection thereof to a source of pressurized water, and a jet nozzle assembly connected to the other end of the hose. The jet nozzle assembly includes a body having at one end an enlarged head containing an ejector opening and means at the other end for frictional attachment of the body to the hose. A spinner sleeve containing at least one tangential opening in rotatably secured to the body.

An axial passage is provided through the body for conducting water from the hose. First reduced diameter passage means connects the axial passage to the ejector opening and second reduced diameter passage means establishes fluid communication between the axial passage and the tangential opening in the spinner.

The system according to the present invention advantageously provides a nozzle jet assembly including a main body and rotating spinner sleeve, both of which are preferably formed of hard materials, such as metals or high density polymer materials, metals and containing a pair of axially spaced annular bearing surfaces underlying the spinner sleeve to form a chamber receiving motive fluid to drive the spinner sleeve as well as to provide an effective journalling device therefor. Also, the main body contains annular barb-like projections extending from the exterior surface thereof that are particularly effective due to their design for connecting the nozzle jet assembly to the flexible hose without fear of dislodgement or leakage over long periods of use. The system employs a flexible hose for connecting the nozzle jet assembly to a source of pressurized liquid in order to accommodate use of the apparatus in applications that require other than straight line coursing as would be required through drain taps, or the like. Further included in the described system is a ball-type operating valve that is adapted to permit rapid supply of pressurized liquid to the nozzle jet assembly. Presence of this form of valve in the system permits pulsing of the pressurized operating fluid that enhances disruption of severe blockages.

Apparatus constructed in accordance with the invention, in addition to being particularly effective for freeing of collected debris from the drains of various household appliances such as sinks, tubs, toilets and garbage disposals, is also contemplated for use in cleaning narrow-neck bottles and flushing automobile radiators. The apparatus also has application for deicing frozen pipes, or the like.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
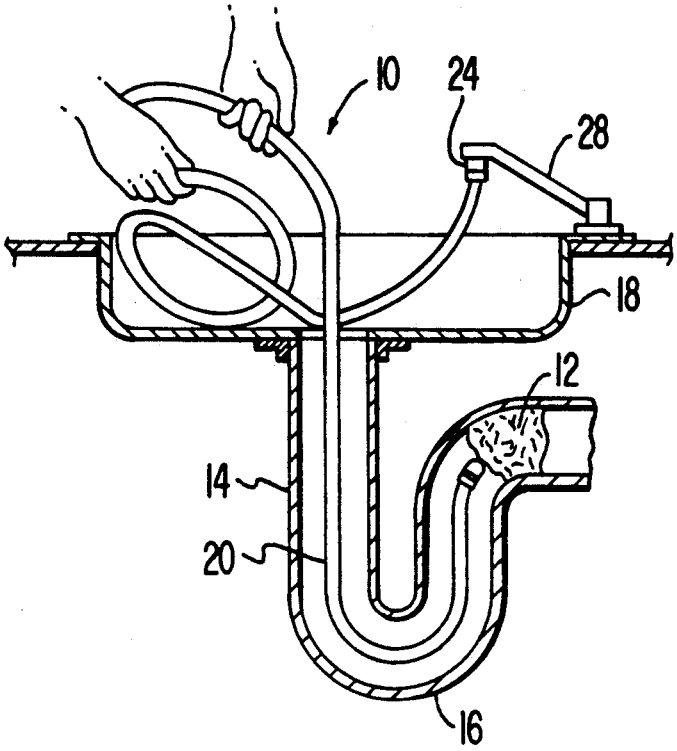
FIG. 1 is a schematic representation illustrating an application of the nozzle jet cleaning system of the present invention.

FIG. 1 of the drawings depicts a fluid jet cleaning system 10 according to the present invention engaged in a typical application for use in cleaning a body of collected debris 12 in a drain 14 downstream of a J-shaped trap 16 creating a blockage in a sink 18. The system 10 comprises a fluid-conducting hose 20 formed of flexible material, such as polyethylene. The upstream end of the hose 20 contains a coupling 22 adapted for threaded connection to the outlet side of a quick-acting valve 24 such as a ball valve, having an on-off actuating lever 26. As shown, the inlet side of the valve 24 is connected to a spout 28 of a faucet 30, connection being effected either directly or via a threaded adapter (not shown).

Figure 2:
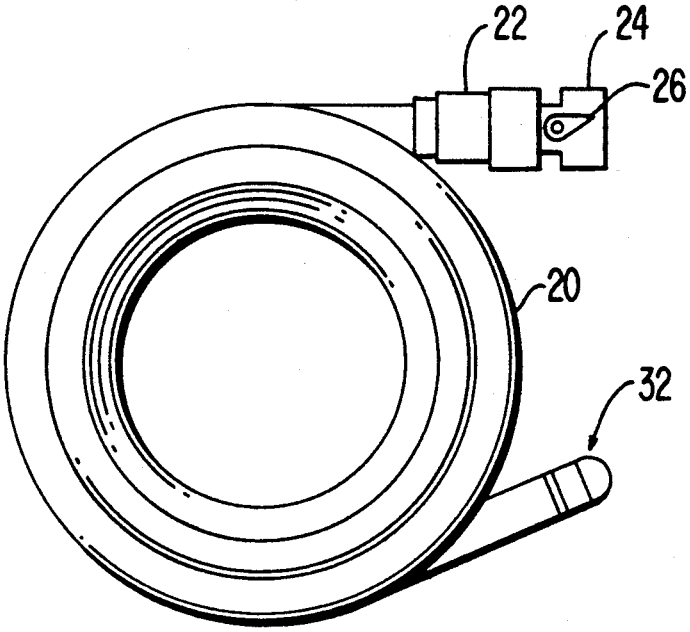
FIG. 2 is a perspective representation of the nozzle jet cleaning system illustrated in FIG. 1.
Figure 3:
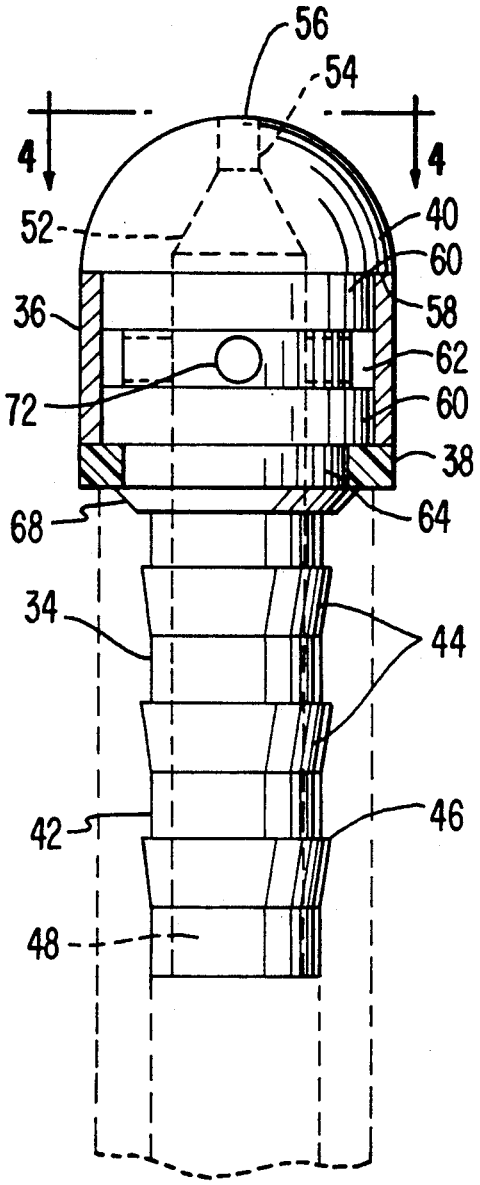
FIG. 3 is an elevational view, partly in section of the nozzle head and spinner assembly of the apparatus illustrated in FIG. 1.
Figure 4:
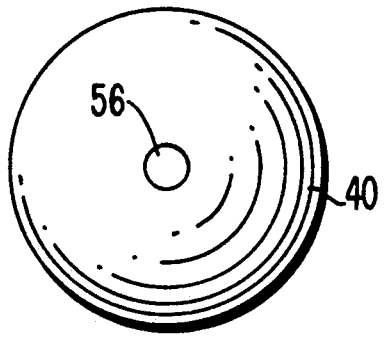
FIG. 4 is a plan view taken along line 4—4 of FIG. 3.

The downstream or discharge end of the hose 20 mounts a nozzle jet assembly, indicated generally as 32 in FIG. 2, the essential parts of which comprise a main body 34, a spinner sleeve 36 and a retainer ring 38, all of which parts may be formed of brass or of an equivalent material. The details of the assembly 32 are best shown in FIGS. 3 to 6. The main body 34 has a leading end that is integrally formed with a hemispherical head 40. The trailing portion 42 of the assembly is generally cylindrically formed with a plurality of annular, axially spaced, integrally-formed barbs 44. Barbs 44 each have an external surface that is conically tapered from a diameter equal to that of the external surface of the portion 42 to a greater diameter at the other end so as to form a series of axially spaced shoulders 46 that penetrate the internal surface of the flexible hose material to securely anchor the main body 34 to the hose 20.

It will be appreciated that, due to the orientation of the shoulders 46 on the main body 34, the tendency of any relative movement in the axial direction tending to move the hose 20 and main body 34 in opposite directions will have the effect enhancing the gripping effect between the barbs 44 and the hose.

An axially extending fluid conducting passage 48 extends through the main body 34. An opening 50 at the trailing end of the main body 34 communicates the passage 48 with the interior of hose 20. Within the head 40 the passage 48 is reduced in diameter via a conical transition section 52 to form an ejector passage 54 that terminates in an ejector opening 56 on the surface of the head.

The main body 34, between an annular shoulder 58 at the lower end of the head 40 and the upper end of the trailing portion 42 possesses a generally castellated configuration for the retention and operation of the spinner sleeve 36. As shown best in FIG. 3, the indicated region of the main body 34 contains a pair of integrally formed annuli 60 whose external surfaces provide bearing support to journal the spinner sleeve 36 and that are mutually axially spaced to form a recess 62 defining an annular chamber beneath the spinner sleeve. Adjacent the lowermost annulus 60 is a second recess 64 intended for reception of a retainer ring 38 that provides a shoulder surface which cooperates with the shoulder 58 to rotatably retain the spinner sleeve therebetween.

The retainer ring 38 may be formed of a somewhat flexible elastomer material and an annular ridge 68 that defines one side of the recess 64 may be provided with a chambered surface to facilitate assembly and retention of the retainer ring and, thereby, the spinner sleeve 36 on the main body 34.

Figure 5:
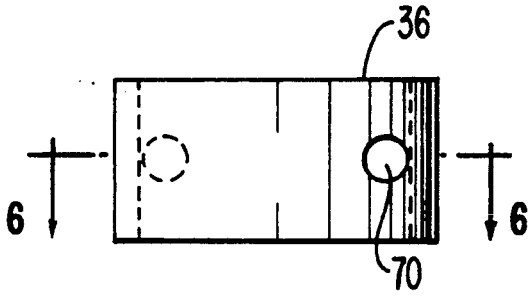
FIG. 5 is an elevational view of the spinner device shown in FIG. 1.
Figure 6:
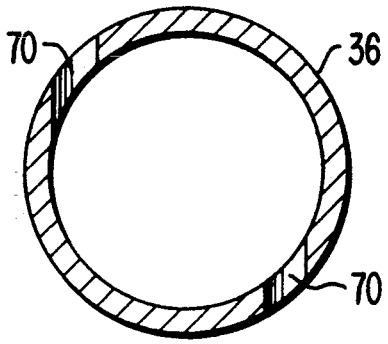
FIG. 6 is a sectional view taken along line 6—6 of FIG. 5.

As shown in FIGS. 5 and 6, the wall of the spinner sleeve 36 is penetrated by a pair of diametrically positioned tangential openings 70 having a diameter less than the width dimension of the chamber-defining recess 62. A plurality of small diameter openings 72, here shown as being four in number, establish fluid connection between the chamber and the main body passage 48 in order to deliver fluid from the passage for ejection from the openings 70 in the spinner sleeve 36 to cause it to rotate while ejecting a pair of high velocity streams of water therefrom.

The operation of the invention can best be described with reference to FIG. 1 wherein the apparatus 10 is illustrated being connected to the valve 24 and the flexible hose 20 extending through the drain 14 with the jet nozzle assembly 32 abutting or closely adjacent the obstruction 12 therein. With the valve 24 initially closed, the faucet 30 is opened to place fluid pressure behind the valve ball (not shown). Thereafter, the actuating lever 26 is rotated about one-half turn to rapidly admit pressurized water through the hose 20 and thence to the jet nozzle assembly 32 where one high velocity jet stream is ejected from the opening 42 formed in the head 40 and a pair of revolving high velocity jet streams are discharged from the openings 70 in the spinner sleeve 36 causing it to rotate while discharging the high velocity water jets.

By means of the high velocity water jet streams exiting the head 40, the obstruction in the drain 16 is effectively impacted serving to disrupt or erode the obstruction to cause its dislodgement. Simultaneously therewith, the revolving jet streams emitted through the openings 70 in the spinner sleeve 36 serve not only to flush away the dislodged debris from the body 12 but also to impact and wash the interior drain wall surface thereby further cleaning the drain, this effect being enhanced by the vortex action created by the revolving streams.

Upon encountering a significantly difficult obstruction, the valve actuating lever 24 can be rapidly oscillated back and forth to cycle the valve repeatedly thus to pulse the water supply to the jet nozzle assembly in order to enhance the blockage-disrupting ability of the apparatus.

While the above description represents one preferred embodiment and application of the invention, it will be understood that various changes in the details, materials and arrangements of parts which have been herein described and illustrated in order to explain the nature of the invention can be made by those skilled in the art within the principle and scope of the invention as expressed in the appended claims.

What is claimed is:

1. A nozzle jet cleaning system, particularly adapted for household use, comprising:

an elongated flexible hose;

coupling means including a gate valve attached at one end of said hose to effect connection thereof with a household source of pressurized water;

a nozzle jet assembly connected to the other end of said hose, including:

a body formed of hard material having at one end an enlarged, generally hemispherical head containing an axially directed ejector opening;

a plurality of axially spaced, annular barbs formed on said body adjacent the other end thereof and effective to frictionally secure said body to said hose;

a hollow, cylindrical spinner sleeve formed of hard material containing a pair of substantially diametrically opposed tangential openings;

means for mounting said spinner sleeve to said body including a pair of axially spaced annular seating surfaces on said body underlying said spinner sleeve for sliding engagement therebetween and cooperating to form an annular chamber communicating with said tangential openings in said spinner sleeve;

an axially extending reduced diameter passage interconnecting said axially extending passage and said ejector opening;

a plurality or radially extending reduced diameter passages interconnecting said supply passage and said annular chamber; and means for securing said spinner sleeve to said body including an annular recess formed in said body closely adjacent the lower end of said spinner sleeve and an annular retainer ring seated in said recess, said retainer ring being formed of flexible plastic material defining an annular, radially extending shoulder sized to cooperate with said enlarged head to loosely retain said spinner sleeve therebetween.

2. A fluid jet cleaning system according to claim 1 in which said hard material is brass.

3. A fluid jet cleaning system according to claim 1 in which said hard material is a high density polymer.

4. A fluid jet cleaning system, particularly adapted for household use, comprising:

an elongated flexible hose;

coupling means at one end of said hose to effect connection thereof to a source of pressurized water;

a jet nozzle assembly connected to the other end of said hose including:

a body having at one end an enlarged head containing an ejector opening and means at the other end for frictional attachment of said body to said hose;

a spinner sleeve containing at least one tangential opening rotatably secured to said body;

means for securing said spinner sleeve to said body including an annular recess in said body and an annular retainer ring mounted in said recess, said retainer ring being formed of flexible plastic material defining a radial shoulder oppositely axially spaced from said enlarged head and sized to loosely retain said spinner sleeve therebetween;

means forming an axial passage through said body for conducting water from said hose;

first reduced diameter passage means connecting said axial passage to said ejector opening; and second reduced diameter passage means for establishing fluid communication between said axial passage and said tangential opening in said spinner.

5. A fluid jet cleaning system, particularly adapted for household use, comprising:

an elongated flexible hose;

coupling means at one end of said hose to effect connection thereof to a source of pressurized water;

a jet nozzle assembly connected to the other end of said hose including:

a body having at one end an enlarged head containing an ejector opening and means at the other end for frictional attachment of said body to said hose;

a spinner sleeve containing at least one tangential opening rotatably secured to said body;

means forming an axial passage through said body for conducting water from said hose;

means for securing said spinner sleeve to said body including an annular retainer ring forming a radial shoulder oppositely axially spaced from said enlarged head and sized to cooperate with said enlarged head to loosely retain said spinner sleeve therebetween;

first reduced diameter passage means connecting said axial passage to said ejector opening; and second reduced diameter passage means including a pair of axially spaced annular seating surfaces on said body effective to slidingly seat said spinner sleeve and cooperating to form an annular chamber beneath said spinner sleeve to establish fluid communication between said axial passage and said spinner by conducting pressurized water from said second reduced diameter passage means to said tangential opening in said spinner.

6. A fluid jet cleaning system, particularly adapted for household use, comprising:

an elongated flexible hose;

coupling means at one end of said hose to effect connection thereof to a source of pressurized water;

a nozzle jet assembly connected to the other end of said hose including:

a body formed of a hard material having at one end an enlarged head containing an ejector opening at one end and means at the other end for frictional attachment of said body to said hose;

a spinner sleeve formed of a hard material containing at least one tangential opening rotatably secured to said body;

means for securing said spinner sleeve to said body including an annular recess in said body and an annular retainer ring mounted in said recess, said retainer ring being formed of flexible plastic material defining a radial shoulder oppositely axially spaced from said enlarged head and sized to loosely retain said spinner sleeve therebetween;

means forming an axial passage through said body for conducting water from said hose;

first reduced diameter passage means connecting said axial passage to said ejector opening; and second reduced diameter passage means for establishing fluid communication between said axial passage and said tangential opening in said spinner.

7. A fluid jet cleaning system, particularly adapted for household use, comprising:

an elongated flexible hose;

coupling means at one end of said hose to effect connection thereof to a source of pressurized water;

a nozzle jet assembly connected to the other end of said hose including:

a body formed of a hard material having at one end an enlarged head containing an ejector opening at one end and means at the other end for frictional attachment of said body to said hose;

a spinner sleeve formed of a hard material containing at least one tangential opening rotatably secured to said body;

means for securing said spinner sleeve to said body including an annular retainer ring forming a radial shoulder oppositely axially spaced from said enlarged head and sized to cooperate with said enlarged head to loosely retain said spinner sleeve therebetween;

means forming an axial passage through said body for conducting water from said hose;

first reduced diameter passage means connecting said axial passage to said ejector opening; and second reduced diameter passage means including a pair of axially spaced annular seating surfaces on said body effective to slidingly seat said spinner sleeve and cooperating to form an annular chamber beneath said spinner sleeve to establish fluid communication between said axial passage and said spinner by conducting pressurized water from said second reduced diameter passage means to said tangential opening in said spinner.

* * * * *